US005316331A

United States Patent [19]

Gorza et al.

[11] Patent Number: 5,316,331

[45] Date of Patent: May 31, 1994

[54] SKI BINDING WITH DEVICE FOR COMPENSATING THE CALIBRATION LOAD FOR TOE UNIT SAFETY RELEASE

[75] Inventors: Roberto Gorza, Feltre; Giorgio Baggio, San Martino Di Lupari; Mirco Battistella, Spresiano, all of Italy

[73] Assignee: Noridca S.p.A., Montebelluna, Italy

[21] Appl. No.: 857,905

[22] Filed: Mar. 26, 1992

[30] Foreign Application Priority Data

Apr. 11, 1991 [IT] Italy ..... 91A-001006

[51] Int. Cl.[5] ..... A63C 9/08

[52] U.S. Cl. ..... 280/618; 280/631

[58] Field of Search ..... 280/620, 623, 631, 636, 280/602, 607, 618

[56] References Cited

U.S. PATENT DOCUMENTS

| | | | |
|---|---|---|---|
| 3,920,256 | 11/1975 | Sittmann | 280/625 |
| 5,046,751 | 9/1991 | Scherubl | 280/607 |
| 5,160,159 | 11/1992 | Gorza et al. | 280/632 |

FOREIGN PATENT DOCUMENTS

| | | | |
|---|---|---|---|
| 296109 | 12/1971 | Austria . | |
| 373786 | 2/1984 | Austria . | |
| 0409749 | 1/1991 | European Pat. Off. | 280/602 |
| 0441251 | 8/1991 | European Pat. Off. . | |
| 0448009 | 9/1991 | European Pat. Off. | 280/631 |
| 1433242 | 5/1965 | France | 280/602 |
| 2263009 | 10/1975 | France . | |
| 2654636 | 5/1991 | France . | |

*Primary Examiner*—Brian L. Johnson

*Attorney, Agent, or Firm*—Guido Modiano; ALbert Josif; Daniel O'Byrne

[57] ABSTRACT

A ski binding with a device for compensating the calibration load for toe unit safety release includes a heel unit with a sliding body and a toe unit which is equipped with a safety release associated with a lamina on which a main spring for toe unit calibration act. An elastic recovery spring interacts between the sliding body which supports the heel unit jaw and the lamina in order to cooperate with the main spring for toe unit calibration when the ski flexes.

6 Claims, 2 Drawing Sheets

SKI BINDING WITH DEVICE FOR COMPENSATING THE CALIBRATION LOAD FOR TOE UNIT SAFETY RELEASE

BACKGROUND OF THE INVENTION

The present invention relates to a ski binding with device for compensating the calibration load for toe unit safety release.

As is known, the ski may flex while skiing, due to the presence of holes or of other discontinuities in the ski-run, as a consequence of the central load constituted by the weight of the skier.

In known bindings, such as for example in the binding illustrated in the U.S. Pat. No. 3,920,256, there is a spring which allows to keep the axial distance between the toe unit and the heel unit constant during the flexing of the ski. This spring, which is commonly termed elastic recovery spring, opposes the rearward motion of the heel unit during the flexing of the ski, which allows to keep the axial distance constant. The load imparted to the elastic recovery spring in practice constitutes an increase in the pressure of the toe unit on the tip of the boot, which consequently increases the value of the preset limit load for the release calibration; this increase has been experimentally found to be approximately equal to 20%.

Increasing the limit load in practice reduces safety, since safety release will be activated at a load threshold higher than the preselected one, since the load which acts at the ends of the boot has increased.

A previous binding of the same applicant instead uses a lamina which interconnects the toe unit and the heel unit below the sole of the boot; the means for calibrating the toe unit release means are accommodated in said heel unit.

With this type of binding, the flexing of the ski would cause a slackening of the calibration means, since the lamina is linked to the axial distance and accordingly, in case of ski flexing, said lamina would move rearward and reduce the calibration load of the spring, which despite being arranged in the heel unit controls the automatic release of the toe unit.

SUMMARY OF THE INVENTION

The aim of the invention is indeed to solve the above described problem by providing a ski binding with a device for compensating the calibration load for the safety release of the toe unit which allows to keep the calibration load substantially unchanged even if the ski flexes.

Within the scope of the above aim, a particular object of the invention is to use elastic recovery means which are able to exert an additional load on the elastic calibration means of the toe unit, thus compensating the load reduction which would occur on said elastic means when the ski flexes.

Another object of the present invention is to provide a ski binding with a device for compensating the calibration load which by virtue of its peculiar constructive characteristics is capable of giving the greatest assurances of reliability and safety in use.

Not least object of the present invention is to provide a ski binding which can be easily obtained, starting from commonly commercially available elements and materials, and is furthermore capable of adapting to all the contingent requirements of use.

This aim, the objects mentioned and others which will become apparent hereinafter are achieved by a ski binding with a device for compensating the calibration load for toe unit safety release, according to the invention, which comprises a heel unit and a toe unit which is equipped with safety release means associated with a lamina on which elastic means for calibrating the toe unit act, said elastic means being accommodated in said heel unit, characterized in that it comprises elastic means for elastic recovery which interact between the sliding body which supports the heel unit jaw and said lamina in order to cooperate with said elastic means for calibrating the toe unit when the ski flexes.

BRIEF DESCRIPTION OF THE DRAWINGS

Further characteristics and advantages will become apparent from the description of a preferred but not exclusive embodiment of a ski binding with device for compensating the calibration load for the safety release of the toe unit, illustrated only by way of non-limitative example in the accompanying drawings, wherein.

DESCRIPTION OF THE PREFERRED EMBODIMENTS

Figure 1:
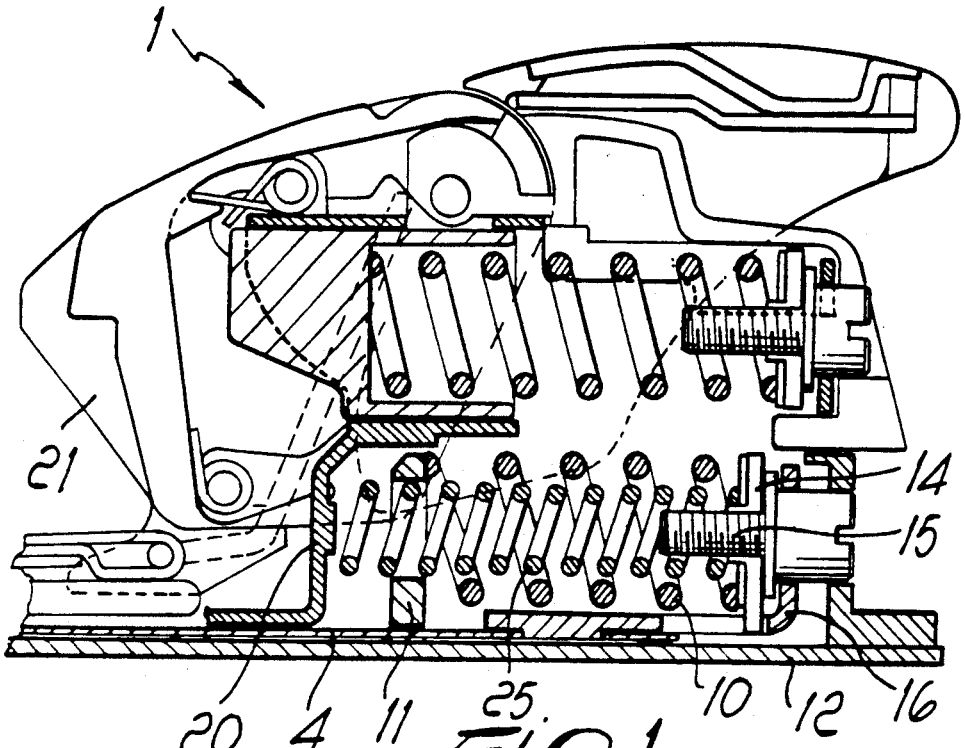
FIG. 1 is a schematic sectional view of the heel unit of a ski binding, illustrating the elastic means for calibrating the toe unit and the elastic means for elastic recovery.
Figure 2:
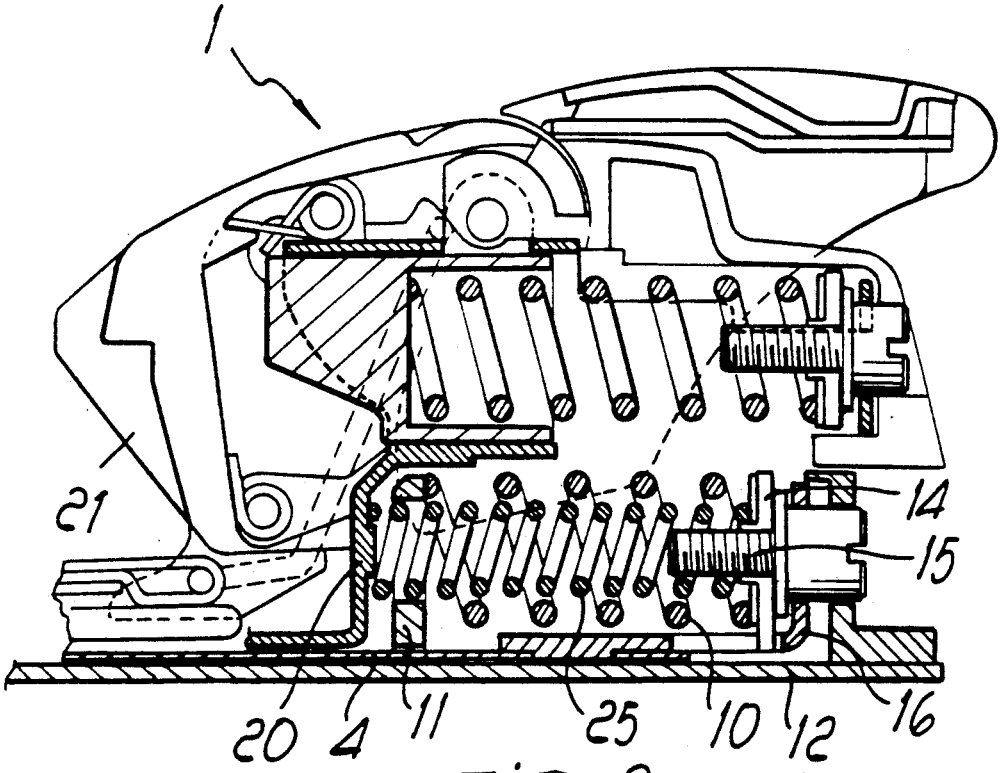
FIG. 2 is a view of the heel unit of FIG. 1, illustrating the position of the elastic means in case of ski flexing.

With reference to the above figures, the ski binding with device for compensating the calibration load for the safety release of the toe unit, according to the invention, comprises a heel unit 1 and a toe unit 2 which are fixed to a ski generally designated by the reference numeral 3.

The toe unit 2 has safety release means which are controlled by a lamina 4 which slidably extends below the sole of a ski boot 5 and interacts with elastic means for calibrating the toe unit which are accommodated in the heel unit 1.

More in detail, the elastic means for calibrating the toe unit comprise a main spring 10 which acts between a shoulder 11, which is fixed to the fixed body 12 of the heel unit and through which the lamina 4 can slide, and a calibration washer 14 which is associated with a calibration screw 15 which abuts against an abutment element 16 which is rigidly associated with the end of the lamina 4.

The peculiarity of the invention is constituted by the fact that there are elastic means for elastic recovery which interact with the heel unit sliding body 20 with which the rear jaw 21 of the heel unit is associated and can slide with respect to the fixed body 12.

The elastic means for elastic recovery comprise a recovery spring 25 interposed between the calibration washer 14, on which the end of the main spring acts, and the sliding body 20.

With the described arrangement, due to the flexing of the ski, the sliding body 20 of the heel unit moves backward toward the rear end of the ski in contrast with the recovery spring 25.

The recovery spring 25 acts on the calibration washer 14, consequently creating an additional load on the lamina which compensates the load reduction of the main spring caused by the rearward movement of the lamina 4 due to the flexing of the ski, since the lamina is arranged on the upper face of the ski, remaining below the boot.

Figure 3:
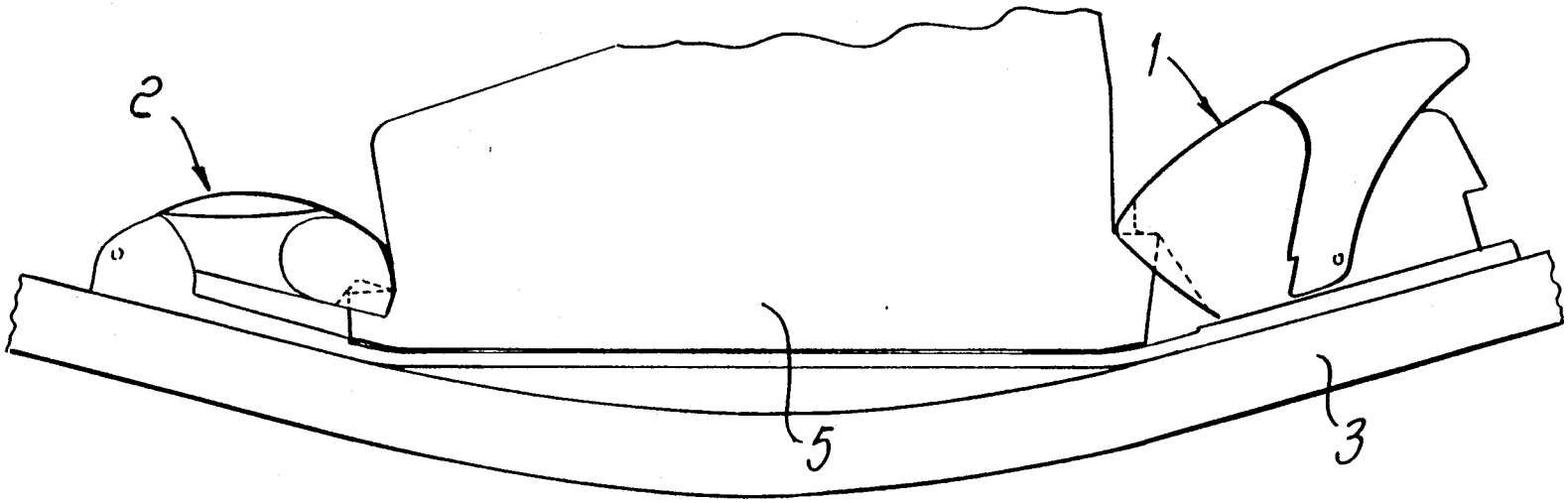
FIG. 3 is a schematic view of the toe unit and of the heel unit applied to a ski during flexing.

Since the lamina is extremely close to the ski, its rearward movement is smaller than the rearward movement undergone by the sliding body, which by means of the jaw, engages the rear part of the ski boot in a point which is spaced with respect to the upper surface of the ski. That is, for a given flexure of the ski as seen in FIG. 3, since the lamina 4 is closer to the ski than are the upper points of contact between the toe and heel units and the upper part of the sole of the ski boot, the radius of curvature for the path containing the end points of the lamina is larger than the radius of curvature for the path containing the contact points of the toe and heel units with the ski boot sole. Therefore, it is seen that the sliding body which follows the smaller radius of curvature moves rearwardly with respect to the fixed body a distance which is greater than the rearward displacement distance of the lamina with respect to the fixed body.

In order to keep the calibration load value constant, the elastic recovery spring 25 must therefore have a different elastic modulus, in particular a smaller one, with respect to the elastic modulus of the main spring 10, so that the different length variations correspond to a same load.

Figure 4:
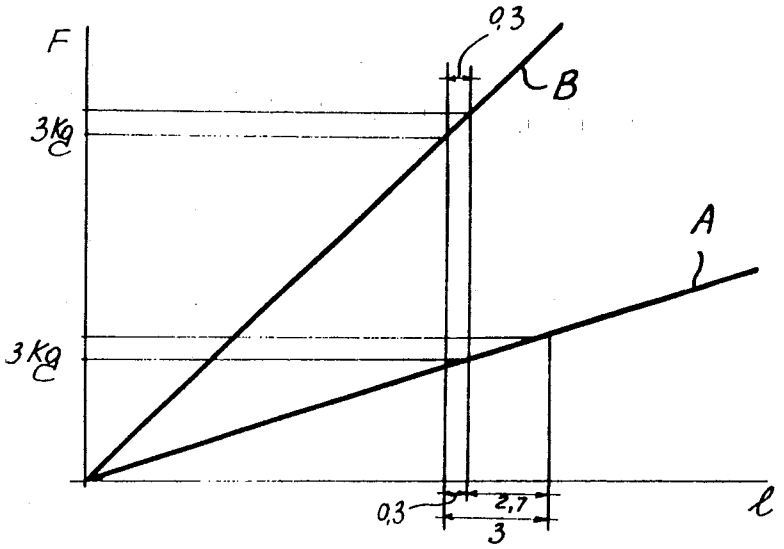
FIG. 4 is a plot of the variation of the elastic load as a function of the shift of the elastic means for elastic recovery and of the elastic means for toe unit calibration.

In particular, as schematically illustrated in the plot of FIG. 4, a reduced elongation of the main spring is matched by a load reduction which is equal to the load increase produced by the compression of the elastic recovery spring 25 by a longer extent.

Experimentally, it has been observed that the lamina, and more precisely the calibration washer which is connected to the lamina, has an elongation of approximately 0.3 mm under an average flexural load; said elongation corresponds to a load loss of approximately 3 kg, and in these conditions the sliding body of the heel unit moves backward by approximately 2.7 mm with respect to the lamina, with an increase of approximately 3 kg in the load of the elastic recovery spring 25, accordingly equal to the amount lost by the other spring.

Essentially, the spring 25 acts on the lamina by means of the calibration washer, is compressed as a consequence of the rearward motion of the sliding body 20 and provides an additional load which corresponds to the elastic load loss undergone by the main spring 10.

The lamina 4 transfers this load situation to the toe unit, so that the preset release load remains unchanged, and this can be obtained since the two springs have a different elastic load; in particular with reference to FIG. 4, it can be seen that the elastic recovery spring, whose plot is designated by A, has a gradient, and thus an elastic modulus, which is smaller than that of the modulus, designated by B, of the main spring 10, so that different variations in length entail a same load variation.

Another important aspect of the invention is constituted by the fact that the elastic recovery spring 25 cooperates in the calibration of the main spring 10 which acts on the toe unit, in practice increasing the rigidity of the ski proportionally to the load of the spring 10; said calibration load is set according to the skier's weight, height, skill, foot size and tibial diameter, as well as according to other aspects which are closely related to each user's type of skiing.

It should be noted that this arrangement in practice allows to keep the camber of the ski substantially constant, since it is reasonable to assume that a lighter skier will flex the ski with less force than a heavier one.

From what has been described above it can thus be seen that the invention achieves the intended aim and objects, and in particular the fact is stressed that elastic means for elastic recovery are provided which cooperate with the elastic toe unit calibration means, so as to keep the safety release load constant regardless of the conditions of use of the ski, i.e. regardless of the flexing of the ski, which does not affect the calibration values due to what has been described above.

The invention thus conceived is susceptible to numerous modifications and variations, all of which are within the scope of the inventive concept.

All the details may furthermore be replaced with other technically equivalent elements.

In practice, the materials employed, so long as compatible with the specific use, as well as the contingent shapes and dimensions, may be any according to the requirements.

We claim:

1. A ski binding comprising a heel holding unit (1) and a toe holding unit (2), the heel holding unit and the toe holding unit being connectable, at a distance apart, to a top portion of a ski (3), the ski binding further comprising a lamina element (4) which is interconnected between said heel holding unit and said toe holding unit and which is slidable with respect to said heel and toe holding units in a longitudinal direction of the ski when said heel and toe holding units are connected to the top portion of the ski, said heel holding unit comprising a fixed body (12) which is rigidly connectable to the ski top portion and a sliding body (20) which is slidably supported by said fixed body, said heel holding unit housing adjustable calibration means (10) for biasing said lamina element with respect to said fixed body in a rearward direction away from said toe unit, said heel holding element further housing elastic recovery means (25) for biasing said lamina element in said rearward direction with respect to said sliding body.

2. The ski binding of claim 1, wherein said elastic recovery means comprise a recovery spring (25) interposed between an inner wall of said sliding body (20) and an upwardly extending abutment element (16) rigidly connected to said lamina element (4).

3. The ski binding of claim 1, wherein said adjustable calibration means comprise a main spring (10 ) interposed between an upwardly extending should (11) rigidly connected to said fixed body (12) and an upwardly extending abutment element (16) rigidly connected to said lamina element (4).

4. The ski binding of claim 3, wherein said adjustable calibration means further comprise a screw element (15) rotatably supported by said abutment element (16) and a washer element (14) screwed on said screw element, said washer element being interposed between said abutment element and said main spring.

5. The ski binding of claim 1, wherein said elastic recovery means comprise a recovery spring (25) interposed between an inner wall of said sliding body (20) and an upwardly extending abutment element (16) rigidly connected to said lamina element (4), wherein said adjustable calibration means comprise a main spring (10) interposed between an upwardly extending should

(11) rigidly connected to said fixed body (12) and said abutment element, and wherein said adjustable calibration means further comprise a screw element (15) rotatably supported by said abutment element and a washer element (14) screwed on said screw element, said washer element being interposed between said abutment element and said main spring, said washer element also being interposed between said abutment element and said recover spring.

6. The ski binding of claim 5, wherein said recovery spring (25) has a smaller elastic modulus with respect to said main spring (10).

* * * * *